United States Patent [19]

Roytberg

[11] 4,292,483

[45] Sep. 29, 1981

[54] IGNITION SWITCH WITH STARTER LOCKOUT

[75] Inventor: Leo F. Roytberg, Brookline, Mass.

[73] Assignee: Joseph Pollak Corporation, Boston, Mass.

[21] Appl. No.: 125,175

[22] Filed: Feb. 27, 1980

[51] Int. Cl.[3] ..... H01H 27/06

[52] U.S. Cl. ..... 200/42 A; 200/44

[58] Field of Search ..... 200/42 R, 42 A, 44, 200/318, 323, 324, 325

[56] References Cited

U.S. PATENT DOCUMENTS

| | | | |
|---|---|---|---|
| 2,121,671 | 8/1934 | Schwarze | 200/44 |
| 3,172,968 | 3/1965 | Arendt | 200/42 A |
| 3,539,737 | 11/1970 | Schupp | 200/44 |
| 3,632,916 | 1/1972 | Schaad | 200/42 A |
| 3,643,044 | 2/1972 | Batcheller | 200/44 |

FOREIGN PATENT DOCUMENTS

| | | | |
|---|---|---|---|
| 2327529 | 1/1974 | Fed. Rep. of Germany | 200/44 |
| 2531467 | 1/1976 | Fed. Rep. of Germany | 200/44 |
| 1160140 | 7/1969 | United Kingdom | 200/44 |
| 2022924 | 12/1979 | United Kingdom | 200/44 |

*Primary Examiner*—John W. Shepperd
*Attorney, Agent, or Firm*—Kenway & Jenney

[57] ABSTRACT

An ignition switch having a starter lockout to prevent attempted restarting of a running engine. The starter lockout includes a slide-mounted orthogonally movable plunger which engages a depression formed in the switch housing upon completion of a movement of the switch rotor to the "START" position and its return to the "ON" position. Repeated movement of the switch rotor directly from the "ON" position to the "START" position is prevented by the engagement of the plunger by the depression in the housing. Disengagement of the plunger from the depression when the rotor is turned in a reverse direction from the "ON" position to the "OFF" position is made possible by a sloped camming surface on either the plunger or the depression which cooperate to urge the plunger back to a normally retracted position.

6 Claims, 7 Drawing Figures

"OFF"

"IG" & "AC" ON

"IG" & "ST" ON

NO RESTART
RETURN TO "OFF"

IGNITION SWITCH WITH STARTER LOCKOUT

BACKGROUND OF THE INVENTION

This invention relates in general to ignition switches and in particular to a so-called starter lockout for such switches which prevents attempted restarting of a running engine.

It has long been recognized that attempting to restart a running engine can cause damage to the flywheel, to the starter, or to other elements of the starting system. Numerous switches have been devised to prevent such attampted restarting of a running engine and many of the devices have proven to be of value. Unfortunately, the more successful of these devices tend to be costly, difficult to fabricate and assemble, and relatively short-lived. The operation of practically all such switches is the same in that several positions are established, generally through the use of detents in a rotary sequence. Perhaps the most common pattern is an accessory position at the furthest counterclockwise position of the switch. Next, in clockwise order, are the OFF position, the ignition and accessory (ON) position, and the START position. The START position is generally springbiased in such a fashion that once starting is achieved, the spring automatically returns the switch to the ON position for ignition and accessories. The lockout feature is usually so designed that having turned the switch to the START position once and released it, one must return the switch to the OFF position before it can be turned to the START position again. Such operation prevents one from attempting to restart an already running engine.

The present invention has as its object a reliable, long-lived rotary switch in which a durable "starter-lockout" system is incorporated to prevent attempted restarting of a running engine. A further object of the present invention is to simplify the fabrication and assembly of such switches and to reduce their cost.

SUMMARY OF THE INVENTION

In the present invention, in addition to the rotor and stationary housing found in most ignition switches, there is incorporated a so-called slide which is normally movable with the rotor and which has a radially relieved section. However, the movement of the slide with the rotor is limited by stops which are provided on the stationary housing. Mounted on the slide is an orthogonally movable spring-loaded plunger which is normally held in a retracted position on the slide, but which is permitted to project outwardly from the slide when it is aligned with the radially relieved slide portion to engage a depression in the stationary housing and prevent a second rotation of the rotor directly from the ignition and accessory position to the START position. The plunger is disengeable from the depression in the stationary housing when the switch is turned in a reverse direction back from the ignition and accessory position toward the OFF position by means of a camming surface on the end of the plunger, the housing, or both. For a better understanding of the present invention together with other and further features and advantages, reference should be made to the appended drawing, in which:

BRIEF DESCRIPTION OF THE DRAWING

FIG. 3 illustrating the position of elements of the switch in the "OFF" position;

FIG. 4 illustrating the position of the elements of the switch in the ignition and accessory "ON" position;

FIG. 5 illustrating the position of elements of the switch in the "START" position;

FIG. 6 illustrating the position of elements of the switch upon return of elements of the switch to the ignition and accessory "ON" position.

DESCRIPTION OF THE PREFERRED EMBODIMENT

Figure 1:
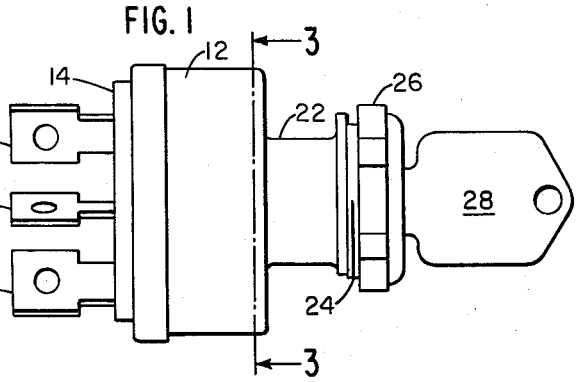
FIG. 1 is a view in elevation of the exterior of an ignition switch built in accordance with the present invention.

In FIG. 1 of the drawing, there is shown the exterior of an ignition switch built in accordance with the present invention. The switch body includes a generally cylindrical central housing 12 which contains the elements most significant in the present invention. At the left of the cylindrical housing 12 is a base plate 14 from which lugs 16, 18, and 20 extend axially. In fact, as may be seen in FIG. 2, there are actually five such lugs, only three of which are shown in FIG. 1 for purposes of simplicity. The base plate may include a central pivot and may be assembled against spring pressure and held in place by spinning the edge of the housing over its periphery.

To the right of the central housing 12 there extends axially a necked down portion 22 also of cylindrical shape which may terminate in a shoulder and threaded mounting section 24. A ring or face nut 26 is provided with internal threading to permit mounting of the switch on a panel or dashboard. An ignition key 28 is shown inserted through the face nut 26 into the necked down portion 22 of the switch.

Figure 2:
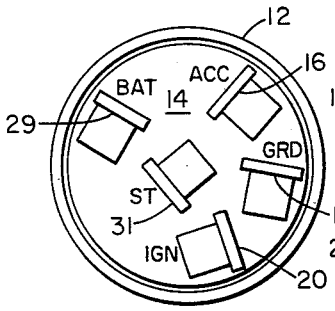
FIG. 2 is an end view of the switch shown in FIG. 1.

In FIG. 2, a typical layout of lugs or terminals on the base plate 14 for connection of the switch into the circuits of a vehicle are shown. The lug 16 may, for example, be for connection to the circuits of the various accessories of the vehicle in which the switch is mounted. The lug 18 may be for a ground connection, and the lug 20 may be for connection to the ignition circuit of the vehicle. A lug 29 is made available for connection to the battery of the vehicle and a lug 31 for connection to the starter motor of the vehicle.

Figure 3:
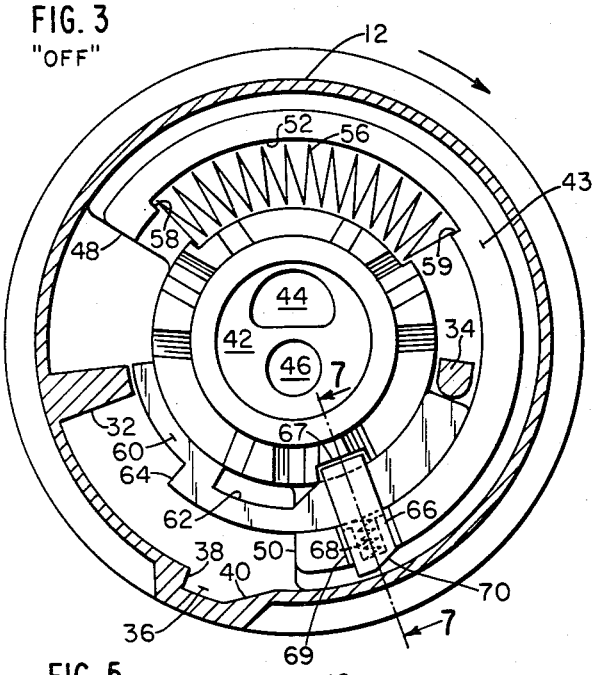
FIGS. 3–6 are cross sections taken along the line 3—3 in FIG. 1.
Figure 4:
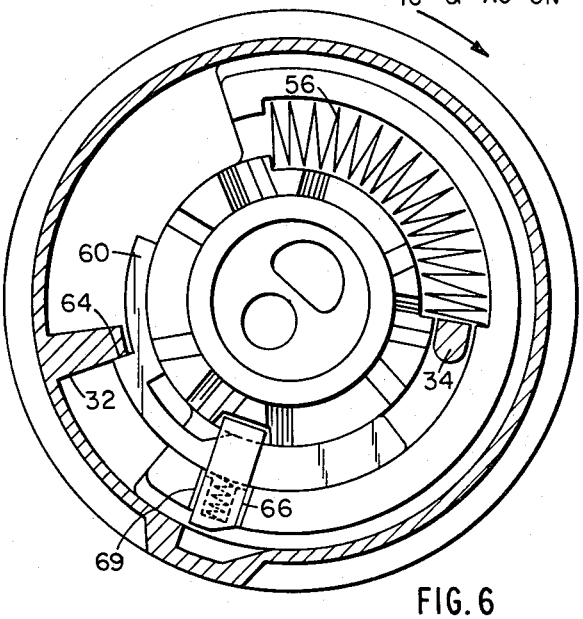
Figure 5:
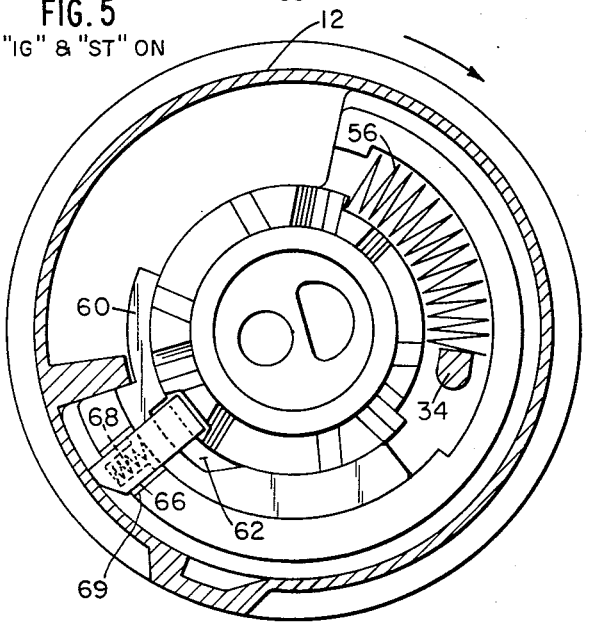
Figure 6:
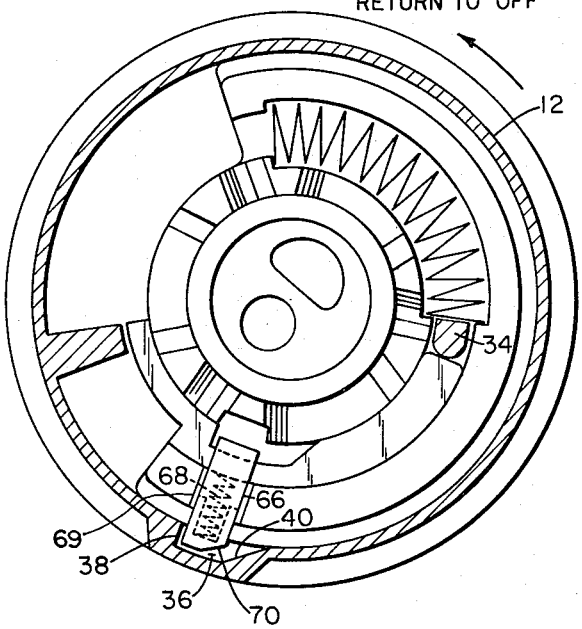

In the cross section of the housing 12 shown in FIG. 3, and in FIGS. 4–6 as well, there may be seen a stop 32 projecting radially inwardly from the housing. Another stop 34 extends axially from an end of the housing. Also formed in the inner wall of the housing 12 is a depression 36 having a straight radial side 38 and a sloped side 40 which forms a ramp. The housing is preferably die cast and the stops and the depression are integrally formed.

Rotatably mounted in the housing 12 is a rotor which includes a core 42 having openings 44 and 46 which are engageable by a follower which rotates with the key 28. An outer portion 43 of the rotor is in the form of an incomplete circular flange having radially extending flat ends or shoulders 48 and 50. The central core 42 of the rotor is generally cylindrical and an arcuate groove 52 is formed between the central core 42 and the outer portion 43 of the rotor to accommodate a coiled spring 56. Shoulders 58 and 59 are formed at the ends of the arcuate groove to retain the spring 56 in place normally under light compression. Other mechanisms for the return function could be employed, of course.

Fitted about a portion of the lower periphery of the core 42 of the rotor is an arcuate slide 60. The slide 60 is in frictional contact with the core and is normally rotatable therewith. Formed in the slide 60 is radially relieved or recessed portion 62 roughly corresponding in shape to the depression 36 in the housing 12. On the outer peripheral edge of the slide 60 there is also formed a shoulder 64.

Figure 7:
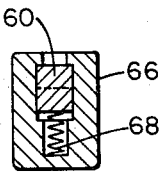
FIG. 7 is a section taken along the line 7—7 in FIG. 3.

As may be seen in FIG. 7, a plunger 66 is mounted on and at substantially right angles to the slide 60. The plunger 66 has a central bore which contains a coil spring 68. Intersecting the central bore at right angles is a slot through which the slide 60 passes. The spring 68 is maintained under compression normally to hold the plunger 66 in position on the slide 60. However, when the plunger 66 moves along the slide 60 into alignment with the relieved or recessed portion 62, it is moved outwardly and orthogonally with respect to the slide 60 by the force of the spring 68.

A recess 67 is formed in the rotor core 42 in alignment with a slot 69 formed in the outer rotor portion 43 to accommodate the plunger 66 and the lower right-hand corner of the plunger 66 is cut away diagonally to form a slop 70.

Operation of the ignition switch may best be understood by referring to FIGS. 3–6. In FIG. 3, the elements of the switch are so positioned that the ignition is off. It will be noted that in the OFF position, the plunger 66 is held on the slide 60 in a position where its top is in the recess 67 of the rotor core 42 and its outer extremity clears the inner wall of the housing 12.

Turning the key 28 in a clockwise direction causes similar motion of the rotor which then reaches the ignition and accessory position shown in FIG. 4. With the rotor in the position shown in FIG. 4, the shoulder 64 of the slide 60 is in contact with the stop 32 on the housing. Also, the spring 56 comes into contact with the stop 34 on the housing. Both the slide 60 and the plunger 66 have rotated with the rotor as shown in the plunger 66 has not moved radially, maintaining its position in orthogonal relationship to the slide.

As the ignition key is turned further and the rotor leaves the position shown in FIG. 4, the plunger 66 moves into radial alignment with the recess 62 on the slide 66. Because the plunger has passed beyond the depression 36, expansion of the spring 68 causes the plunger to extend into contact with the inner wall of the housing 12, the position which it retains with further rotation as shown in FIG. 5 where energization of the START circuit occurs while ignition and accessory circuits are retained closed. With the rotor as shown in FIG. 5, the spring 56 is compressed against the stop 34 for return action described below.

In the event that the engine starts and the key 28 is released, the force of the spring 56 causes the rotor to move in a counterclockwise direction until it reaches the position shown in FIG. 6. In this position, both the ignition and accessory circuits remain energized and the plunger 66 is further extended by the force of the spring 68 until it enters the depression 36 in the housing 12. With the rotor in the position shown in FIG. 6, any attempt to restart the engine by turning the key clockwise is prevented by contact of the straight side of the plunger with the straight radial edge 38 of the depression 36 in the housing. On the other hand, should the first start fail, the engine may be started by turning the key (and rotor) counterclockwise back to the position shown in FIG. 3, namely, the OFF position. Such counterclockwise motion is possible because either a slope such as 70 on the plunger 66 or a slope such as the ramp 40, or both, cam the plunger radially inwardly. At the same time, the end of the slide 60 is in contact with the stop 34 on the housing 12 and further rotation of the slide 60 in a counterclockwise direction is not possible. Also, the sloped edge on the recessed portion 62 of the slide 60 which matches that on the depression 36 facilitates movement of the plunger 66 relative to the slide 60 to permit it to reassume the position on the slide 60 that is occupied as illustrated in FIG. 3.

A further position of the rotor for energization of accessories only is available, although it is not illustrated. If the rotor is turned in a counterclockwise direction from the position shown in FIG. 3, the shoulder 48 of the rotor will encounter the stop 32 on the housing 12. Because the slide 60 is in contact with the stop 34, it will not move with the rotor in a counterclockwise direction, although the plunger 66 will be moved further in a counterclockwise direction along the slide 60. This movement of the plunger will have no effect upon the operation of the switch as described above for its lock-out function which prevents false restarting.

In the completed assembly of the switch, suitable pivots, and spring loading, are utilized to maintain the components in proper operating relationship. These elements are only indirectly related to the ignition and are not described in detail. Also, conventional interconnections between the various terminals which are established and detents which maintain the rotor in the various described positions of the switch are shown but not described in detail. What is described in the foregoing detailed description is one form that the invention may take, the breadth of the invention being limited only by the spirit and scope of the appended claims.

What is claimed is:

1. In a rotary switch having a stationary element and a rotary element, said rotary element being rotatable relative to said stationary element from one position to another to selectively energize circuits in a predetermined sequence, apparatus for preventing repeated energization of one of said circuits by movement in a first direction of said rotary element from a given position directly to a position adjacent thereto comprising a third element in frictional contact and normally rotatable with said rotary element, stops being provided on said stationary element to limit rotation of said third element with said rotary element, a fourth element rotatable with said rotary element and movable along said third element upon said third element engaging one of said stops on said stationary element and means disposed on said stationary element for engaging said fourth element, said third element having a portion thereof relieved to permit orthogonal movement of said fourth element relative thereto, said orthogonal movement resulting in engagement of said fourth element by said means disposed on said stationary element, the position of one of said stops and the position of said relieved portion of said third element being such that said fourth element is aligned with the relieved portion after the rotary element has been rotated beyond said given position in said first direction.

2. In a rotary switch as defined in claim 1, the combination wherein said rotary element is generally cylindrical in shape, said third element comprising an arcuate slide having an inner surface conforming to and normally frictionally engaged by a portion of the outer surface of said rotary element to permit predetermined limited rotation of said slide, said limited rotation of said slide being terminated by contact thereof with one of said stops provided on said stationary element, further movement of said rotary element in said first direction aligning said fourth element with said relieved portion of said slide to permit said orthogonal movement of said fourth element for engagement thereof by said means disposed on said stationary element upon said rotation of said rotary element in said direction opposite to said first direction.

3. In a rotary switch as defined in claim 1, the combination wherein said stationary element comprises a generally cylindrical housing, said rotary element comprises a generally cylindrical rotor concentrically disposed and rotatable within said housing, said third element comprises an arcuate slide in frictional contact and normally rotatable with said rotor, said fourth element comprises a plunger mounted upon and normally spring-loaded to be maintained in a given position upon said slide, said slide having a radially relieved portion which when aligned with said plunger permits orthogonal movement of said plunger relative to said slide, and said means disposed on said housing for engaging said fourth element comprises a depression formed in said housing, whereby engagement of said plunger by said depression prevents rotation of said rotor in said first direction and repeated energization of said one of said circuits.

4. In a rotary switch as defined in claim 3, the combination in which said depression in said housing has a straight side and said plunger has a straight side, said straight sides contacting each other upon attempted repeated rotation in said first direction of said rotor from said given position to said position adjacent thereto; thus blocking repeated rotation of said rotor from said given position to said position adjacent thereto upon engagement of said plunger by said depression.

5. In a rotary switch as defined in claim 4, the further combination therewith of resilient means disposed between said rotor and one of said stops, said resilient means being arranged to resist rotation of said rotor from said given position to said position adjacent thereto and to urge said rotor back to said given position in the absence of applied external rotational force.

6. In a rotary switch as defined in claim 4, the further combination therewith of a shoulder formed on said rotor and a spring disposed between one of said stops on said cylindrical housing and said shoulder, said spring being compressed upon rotation of said rotor from said given position to said position adjacent thereto and operative upon expansion thereof to urge said rotor back to said given position from said position adjacent thereto.

* * * * *